US010393458B2

(12) United States Patent
Ballantyne et al.

(10) Patent No.: US 10,393,458 B2
(45) Date of Patent: Aug. 27, 2019

(54) AXIALLY RELIEVED BOLT FACE FOR BLOWBACK BOLT FIREARMS

(71) Applicant: Quarter Circle 10, LLC, Tucson, AZ (US)

(72) Inventors: James L. Ballantyne, Tucson, AZ (US); Anthony W. Castaneda, Tucson, AZ (US); Alan L. Cowgill, Tucson, AZ (US)

(73) Assignee: Quarter Circle 10, LLC, Tucson, AZ (US)

( * ) Notice: Subject to any disclaimer, the term of this patent is extended or adjusted under 35 U.S.C. 154(b) by 0 days.

(21) Appl. No.: 15/711,874

(22) Filed: Sep. 21, 2017

(65) Prior Publication Data

US 2018/0087855 A1 Mar. 29, 2018

Related U.S. Application Data

(60) Provisional application No. 62/397,812, filed on Sep. 21, 2016, provisional application No. 62/397,817, filed on Sep. 21, 2016.

(51) Int. Cl.

| | |
|---|---|
| ***F41A 15/14*** | (2006.01) |
| ***F41A 5/02*** | (2006.01) |
| ***F41A 9/41*** | (2006.01) |
| *F41A 15/16* | (2006.01) |

(52) U.S. Cl.

CPC ..... *F41A 15/14* (2013.01); *F41A 5/02* (2013.01); *F41A 9/41* (2013.01); *F41A 15/16* (2013.01)

(58) Field of Classification Search

CPC .. F41A 15/14; F41A 15/16; F41A 5/02; F41A 9/41

USPC ..... 42/14–16, 25, 69.02, 49.01; 89/197

See application file for complete search history.

(56) References Cited

U.S. PATENT DOCUMENTS

| | | | | |
|---|---|---|---|---|
| 2,465,553 | A * | 3/1949 | Robinson, Jr. | F41A 15/14 42/25 |
| 3,771,415 | A * | 11/1973 | Into | F41A 3/78 42/16 |
| 3,906,833 | A * | 9/1975 | Orozco | F41A 3/12 42/72 |
| 4,440,062 | A * | 4/1984 | McQueen | F41A 15/14 89/128 |
| 5,499,569 | A * | 3/1996 | Schuetz | F41A 3/54 42/25 |
| 5,520,019 | A * | 5/1996 | Schuetz | F41A 3/54 42/49.02 |
| 2002/0178632 | A1* | 12/2002 | Strayer | F41A 3/64 42/16 |
| 2017/0016688 | A1* | 1/2017 | Withey | F41A 3/22 |

* cited by examiner

*Primary Examiner* — John Cooper

(74) *Attorney, Agent, or Firm* — Charmasson, Buchaca & Leach, LLP

(57) ABSTRACT

A blowback bolt for a firearm has a distal bolt face having an axially relieved lower lip closest to the ammunition magazine. The axial relieved lip strips the lead cartridge from the magazine by contacting the rim of the cartridge and scoops it into the counterbore seat on the distal bolt face while maintaining contact with the rim. Chamfered lateral guides at the angular extremities of an arcuate upper guide-wall restrict lateral movement of the rim during the scooping.

17 Claims, 7 Drawing Sheets

AXIALLY RELIEVED BOLT FACE FOR BLOWBACK BOLT FIREARMS

PRIOR APPLICATION

This application claims the benefit of U.S. Provisional Patent Application Ser. No. 62/397,812, filed 2016 Sep. 21, and U.S. Provisional Patent Application Ser. No. 62/397,817, filed 2016 Sep. 21, both of which are fully incorporated herein by reference.

FIELD OF THE INVENTION

The invention relates to firearms, and more particularly to mechanisms for stripping and chambering cartridges from the ammunition magazine for blowback bolt style firearms.

BACKGROUND

Most firearms provide mechanisms to facilitate the automated handling of ammunition components as they are used. A firing cycle can include the stages of: stripping an unfired ammunition cartridge from a spring-loaded multi-cartridge magazine, chambering the cartridge; firing; extraction of the spent cartridge casing from the chamber; and, ejection of spent cartridge casing from the firearm. A blowback bolt mechanism uses some of the force of the pressurized gasses generated by the burning propellant in the cartridge to accomplish operation of the cycle in an automatic or semi-automatic way. Blowback style bolt action firearms have been around for many years.

Typically prior blowback style bolts, after being driven rearwardly by firing, will automatically spring back forwardly on a return stroke. During the forward return stroke, the rapidly moving bolt will strip the lead cartridge from a queue of unfired cartridges supplied by a spring-loaded magazine, and drive the stripped cartridge into the chamber. During the stripping and chambering process, the forward facing end of the bolt contacts the rear rim of the lead cartridge and must allow the rim to slide upward so that the rim becomes properly seated against the bolt by the time the bolt face reaches its fully forward firing position. If not handled precisely, the cartridge can rapidly become improperly oriented, leading to ammunition handling problems such as jamming.

Indeed, the main problem with conventional blowback style bolts is the temporary loss of control of the cartridge being loaded. Because the magazine typically supplies cartridges in a slightly "nose-up" orientation, the orientation of the stripped cartridge must change by the time the cartridge is chambered. While being stripped from the magazine and inserted into the barrel's chamber, there is a point where the velocity and control of the cartridge is temporarily lost as the cartridge rim slides over the edge of the driving ledge of the bolt, and falls into the piloting bore at the front end of the bolt. In addition, the loading impact and force to the cartridge is directed to a small peripheral area of the bolt, primarily about the leading edge of the bolt face, until the cartridge angle squares up to the bolt as it is piloting into the barrel bore, when the cartridge falls squarely into the bolt's cartridge pilot bore. During this time very little surface area of the cartridge is being contacted leading to loss of control. Such conventional bolts provide little if any lateral control of the cartridge during the loading process. As the cartridge is stripped from the magazine it can move about on the raised lip of the bolt until it is constrained by the chamber of the barrel late in the loading process where it finally forces the rim to fall into the counter bored seat for the cartridge as the bolt comes to rest against the barrel chamber. Such unpredictable moving about as a result of loss of control can lead to cartridge handling problems such as jamming and excessive wear.

Basic operation of any firearm bolt is to forcibly remove, or strip an unfired cartridge from a magazine, and transport it to the chamber of the barrel for firing. After firing the cartridge's projectile, the blow-back bolt moves away from the barrel's chamber controlling the rear of the cartridge until the point where the extractor and ejector mechanisms eject the spent cartridge casing from the bolt's path so the process can repeat. While stripping the cartridge from the magazine, spring loaded forces from the magazine's retention mechanics can exert lateral directional forces to the cartridge during the cartridge release. With prior art bolts, these lateral forces come to play more readily while the cartridge is being freed from the magazine at bolt velocity to seating into the barrel chamber. These forces can drive the cartridge laterally during loading and create issues from simple force vectored energy absorption slowing cyclic rates, to creating inconsistent load feeds, to complete load failures or "jamming" where the cartridge is cocked at an interference angle to the chamber, stopping the bolt from seating at the fire position. With prior art bolts the lateral forces are compounded by the lack of cartridge control of the rear section of the cartridge, at the rim, until the point in the loading process when the cartridge "falls" over the lip of the bolt into the counter bored seat for the cartridge where it continues the final short path to seating in the barrel's chamber.

Therefore, there is a need for cartridge stripping mechanism which addresses some or all of the above identified inadequacies.

SUMMARY

The principal and secondary objects of the invention are to provide improved control over cartridge stripping for blowback bolt firearms. These and other objects are achieved by an axially relieved portion of the bolt face of the firearm.

In some embodiments there is provided a high-speed semi-automatic or automatic blowback bolt construction having an axially relieved portion of the bolt face that better controls and feeds cartridges into the chamber of firearms.

In some embodiments there is provided a strip-lip, or offset in the face of the bolt which has the magazine facing portion of the bolt surface relieved back from the main bolt to barrel impact surface, and laid back via chamfer or radius to more smoothly strip the cartridge from the magazine.

In some embodiments, while the bolt removes the cartridge from the magazine, the side guiding of the cartridge via the side controlling walls created by the differential surface transition between the bolt impact surface and the magazine side relieved surface maintain additional lateral cartridge control not previously attainable.

In some embodiments, the axially relieved impact surface of the bolt is located nearest the magazine.

In some embodiments, the channel type guiding for the cartridge created when creating the relieved impact surface of the strip-lip, or relieved lip nearest the magazine.

In some embodiments the strip-lip blowback bolt better controls the random forces exerted upon the cartridge during the bolt's driving force of stripping the cartridge from the magazine, and maintains a consistent control and velocity of the cartridge to full fire-ready position in the chamber of the barrel.

In some embodiments the strip-lip blowback bolt removes the inconsistency of loading velocity of the cartridge due to the cartridge dropping over the leading edge of the bolt into the piloting bore for the final insertion into the barrel's chamber.

In some embodiments the strip-lip blowback bolt removes potential binding and/or lateral cartridge impact points along its length in order to controllably lift the rear of the cartridge smoothly into a controlled loaded position.

In some embodiments the strip-lip blowback bolt maintains lateral control of the cartridge while "scooping" the cartridge from the magazine by creating lateral side guides on the bolt to better control inconsistent forces exerted upon the cartridge, and guide the cartridge from the rear during loading into the barrel's chamber.

In some embodiments it is provided that in a firearm having a bolt reciprocatingly sliding axially along a bolt axis, said bolt temporarily engaging an ammunition cartridge at a distal bolt end during a firing cycle, wherein said ammunition cartridge includes a cylindrical case portion having a proximal circular rim, an improvement which comprises: a distal bolt face which comprises: a distal impact surface; a substantially circular counterbore seat radially adjacent to said distal impact surface; a distally projecting arcuate guidewall partially surrounding an upper portion of said seat; said guidewall being angularly limited to provide a lower angular gap; and an axially relieved lip located within said gap.

In some embodiments the improvement further comprises: a pair of lateral guides formed onto the angular extremities of said guidewall.

In some embodiments each of said lateral guides forms a gradual transition between a radially inner surface of said guidewall and an angular edge of said guidewall.

In some embodiments said lip is shaped and dimensioned to allow simultaneous contact between said lip, said rim and said counterbore seat.

In some embodiments said bolt strips and chambers a cartridge at substantially the same velocity as a return stroke of the bolt.

In some embodiments the improvement further comprises: said distal impact surface being substantially planar, located within a first plane; a distal surface of said lip being substantially planar, located within a second plane; and, wherein said first plane is located an axial distance distal to said second plane.

In some embodiments said first and second planes are substantially parallel.

In some embodiments said second plane is substantially perpendicular to a sliding axis of said bolt.

In some embodiments said angular gap is between about 150 degrees and about 160 degrees.

In some embodiments said lip is supported by a distally projecting pedestal radially adjacent to said seat.

In some embodiments said lip further comprises a concave arcuate radially inwardly facing lip wall shaped and dimensioned to nest against a convex surface of said rim.

In some embodiments said lip wall and said rim have commensurate radii of curvature.

In some embodiments said lip further comprises a pair of convex corners straddling said lip wall.

In some embodiments said pedestal has axial dimension of between about 0.053 and about 0.057 inch.

In some embodiments said lip further comprises a ramp extending radially inwardly and proximally forming a gradual transition surface to said pedestal.

In some embodiments the improvement further comprises an extractor mechanism having a radially moveable arcuate hook oriented to contact said cartridge In some embodiments there is provided a method for stripping an ammunition cartridge from a magazine and chambering said cartridge in the chamber of a firearm using a blowback bolt having a proximal counterbore seat, said cartridge case having a proximal rim, said method comprises: simultaneously contacting said rim by a first surface on a lower lip of said bolt adjacent to said seat, and a second surface on said counterbore seat.

The text of the original claims is incorporated herein by reference as describing features in some embodiments.

DESCRIPTION OF THE EXEMPLARY EMBODIMENTS

It is important to note that in the exemplary embodiments shown, many critical firearm features, such as the firing pin, triggering mechanisms, ejector mechanisms, and direct gas impingement channeling have been omitted from some of the firearm illustrations in order to improve clarity. Those skilled in the art will readily recognize where such features can be expected to reside in a more complete illustration.

Figure 1:
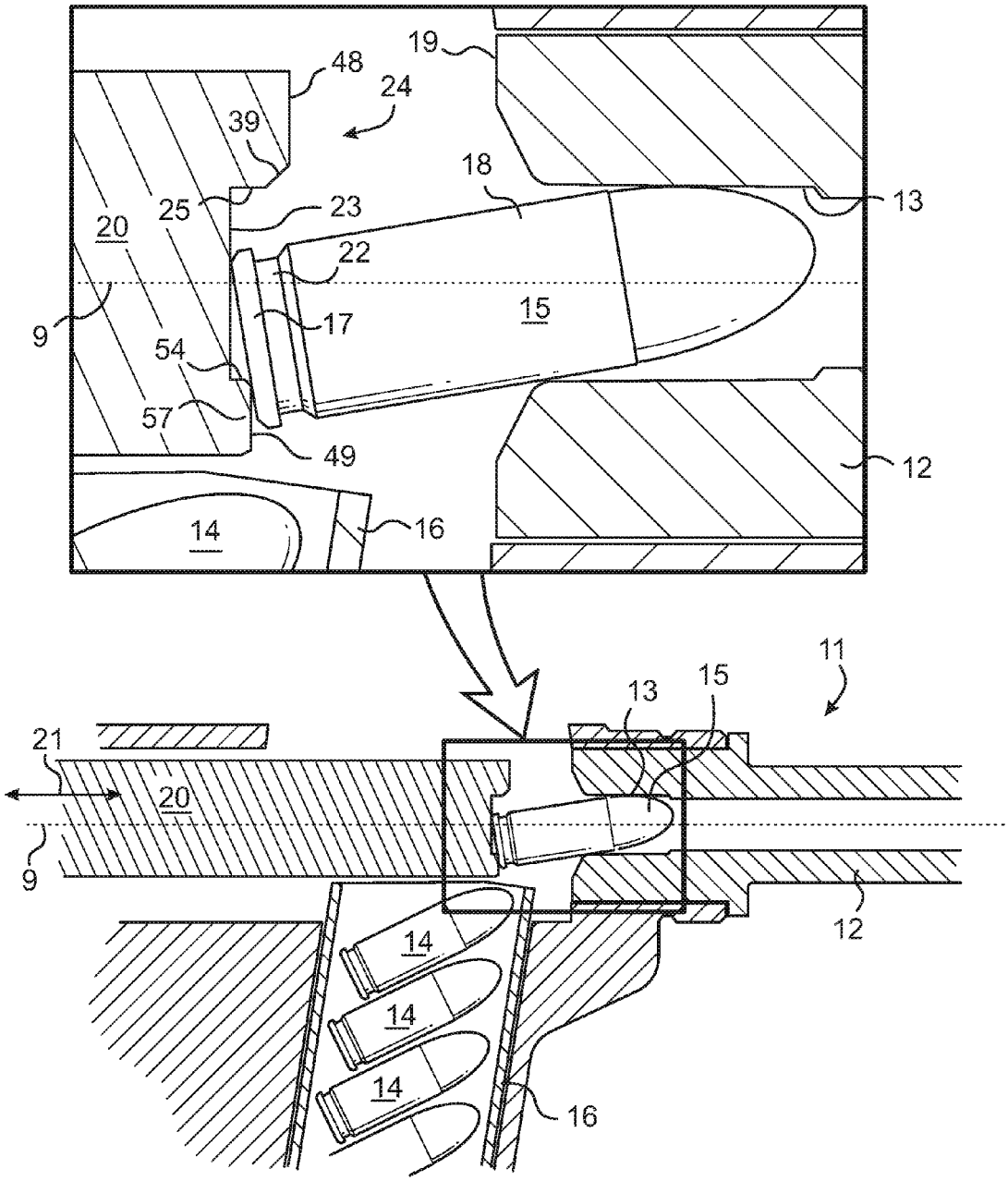
FIG. 1 is a diagrammatic, partially enlarged cross-sectional side view of a firearm having a bolt having an axially relieved lower lip according to an exemplary embodiment of the invention.

Referring now to the drawing, there is illustrated in FIG. 1 a semiautomatic pistol type firearm 11 similar to a Glock brand 9 mm pistol commercially available from the Glock, Inc. company of Smyrna, Ga. The firearm includes an elongated barrel 12 extending between a distal muzzle (not shown) and a proximal chamber 13 for holding an ammunition cartridge 15 during firing. Additional cartridges 14 are successively loaded from a magazine 16 into the chamber by operation a bolt 20 which reciprocatingly slides 21 along an axis 9 substantially parallel to the barrel. The distal end 24 of the bolt has a counterbore 23 forming an axially recessed seat for nesting the proximal base or rim 17 of the cartridge casing 18 during the chambered, firing and extraction stages of the firing cycle. The bolt 20 also carries a firing pin (not shown) which axially strikes the primer set into the cartridge base to initiate the firing of the cartridge.

Except where otherwise noted, the terms "axial", "axially", "radial", and "radially" are in reference to the bolt 20 sliding axis 9. Further, "front", "forward" and "forwardly" can be used to denote the distal part of a structure or the distal direction toward the muzzle, and "rear", "rearward" and "rearwardly" can be used to denote the proximal part of a structure or the proximal direction opposite from the distal direction.

Figure 2:
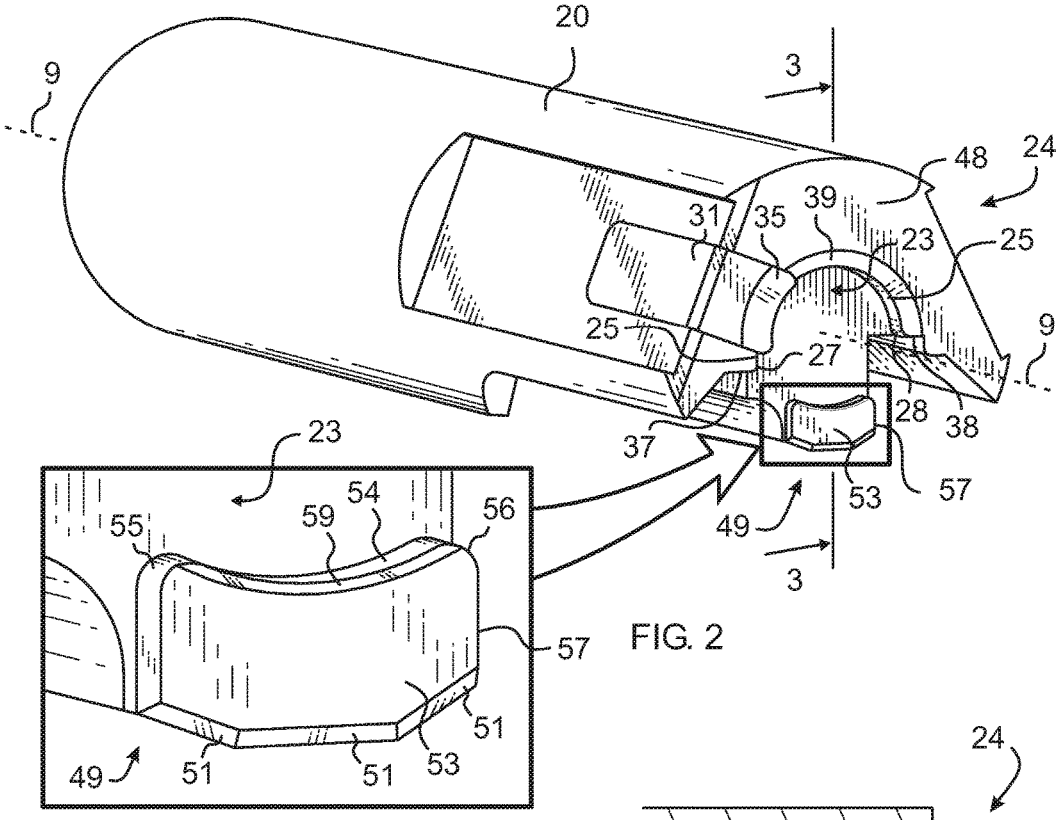
FIG. 2 is a diagrammatic, partially enlarged perspective view of a firearm bolt having an axially relieved lower lip according to an exemplary embodiment of the invention.
Figure 4:
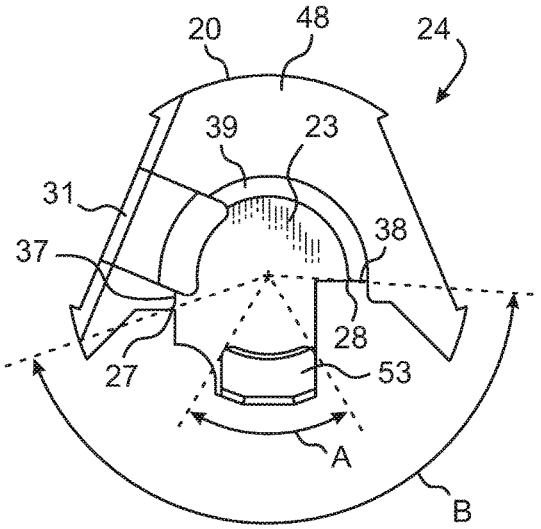
FIG. 4 is a diagrammatic, partial elevational front view of the distal face of the bolt of FIG. 1.
Figure 3:
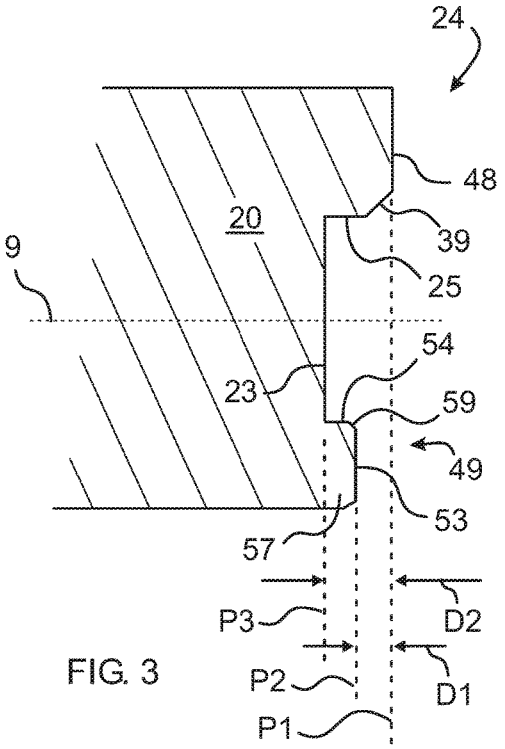
FIG. 3 is a diagrammatic, partial cross-sectional side view distal face of the bolt of FIG. 1.

FIGS. 2-4 show the distal end of the bolt 20 has a distal face 24 having a distal impact surface 48 which bears against the proximal end 19 of the barrel 12 surrounding the chamber 13 when a cartridge is chambered and ready for firing. The counterbore seat 23 set proximally into the distal end of the bolt radially adjacent to the distal impact surface can form an arcuate, partial, distally projecting, upper guidewall 25 on the upper portion of the bolt distal end. Thus the guidewall and cartridge rim edge can have commensurate radii of curvature. The guidewall can extend in an angularly limited manner around the upper periphery of the counterbore seat terminating in a pair of lateral guides 27,28 at the angular extremities of the guidewall, and leaving an angular gap around the lower periphery of the seat. As shown in FIG. 4 the gap can have angular dimension B of between about 145 and 165 degrees in the above embodiment, and more preferably between about 150 and 160 degrees, and most preferably about 155 degrees.

Each of the lateral guides can be formed by a rounded chamfer. The chamfer creates a gradual transition between the substantially cylindrical inner surface of the guidewall and angular edges 37,38 of the guidewall. Alternately, but less desirably, a series of bevels or other gradual transitioning can be used. In addition, a substantially conical bevel 39 can form the transition between the guidewall 25 and distal impact surface 48.

An extractor mechanism 31 can provide a radially moveable arcuate hook 35 for temporarily engaging the circumferential groove 22 near the rim 17 of the cartridge 15 in order to help extract the spent cartridge casing 18 from the chamber 13 after firing an prior to ejection. The extractor mechanism can interrupt the continuity of the guidewall. Indeed, a portion of the guidewall forming the angular edge 37 and lateral guide 27 closest to the extractor mechanism can be located a further radial distance outward, staying clear of the extractor mechanism which can serve additionally to guide the cartridge onto the counterbore seat during chambering.

The distal face 24 of the bolt 20 also includes an axially relieved lower lip 49 on the part of the distal end closest to the magazine 16. The distal surface 53 of the axially relieved lip is supported by a pedestal 57 projecting distally from and radially adjacent to the counterbore seat 23. The pedestal is shaped, dimensioned and positioned axially to allow the lip to engage and bear against the rim 17 of a cartridge 15 as it is stripped from the magazine. Further, as shown in FIG. 1, during the mid-point of the stripping and chambering stages of the firing cycle, in other words, between the start of the stripping of the cartridge from the magazine and the fully chambered cartridge, the lip can simultaneously contact the rim while the counterbore seat first contacts the rim. This allows a more gradual and controlled movement of the cartridge while being stripped and becoming fully seated upon the distal face of the bolt.

The pedestal can have a concave, arcuate, radially inward facing lip wall 54 shaped and dimensioned to intimately nest against a convex radial edge of the cartridge rim 17. Thus the lip wall and cartridge rim edge can have commensurate radii of curvature. A ramp 59 extending radially inwardly and proximally can form the transition between the lip wall 54 and distal surface 53 of the lip 49. The ramp can be formed by a substantially conical bevel which can be at about a 45 degree angle to the bolt axis. A series of facets 51 can provide a gradual transition between the distal surface 53 of the lip and the radially outward periphery of the bolt 20. The facets help avoid sharp edges catching on structures such as the cartridge rim. The facets can be oriented at about 30 degrees to the bolt axis. The lip can also include a pair of rounded, convex corners 55,56 at the angular extremities of the lip wall to further guide the cartridge rim onto the counterbore seat as the rim slides radially inwardly over the lip.

As shown in FIG. 3, the distal face 48 is located an axial distance distally D1 from the distal surface 53 of the lip 49 closest to the magazine, which is less than or equal to the axial distance D2 from the distal face 48 to the counterbore seat 23. For a typical pistol type firearms in this embodiment, D1 can range between about 0.074 to about 0.076 inch, whereas D2 can range between about 0.129 to about 0.131 inch. Thus the axial dimension of the pedestal can range between about 0.053 and about 0.057 inch in this embodiment.

The distal face of the bolt, the lower lip, and the counterbore seat can all reside substantially within planes P1,P2, P3 respectively, which can be parallel to one another and perpendicular to the sliding axis 9 of the bolt. This axially relieved lip on the lower edge of the distal end of the bolt, and the corresponding wall and lateral guiding structures on the periphery of the counterbore seat, help provide greater control over the cartridge 15 by funneling the rim into the counterbore seat without rapid changes in velocity as it is being stripped from the magazine and chambered.

As shown in FIG. 4, the above shaping, dimensioning and positioning of the lip 49 results in a pedestal 57 that is symmetric about a vertical plane 3 bisecting the counterbore seat 23 and can have an angular dimension A of between about 55 and 65 degrees in the above embodiment, and more preferably between about 58 and 62 degrees, and most preferably about 60 degrees.

This geometry allows the rim of the cartridge to slide radially across the surfaces of the lip and onto the counterbore seat in a gradual manner while being laterally constrained by the lateral guides of the guidewall. This way, the bolt strips and chambers the cartridge at substantially the same velocity as the return stroke of the bolt.

Referring now to FIGS. 5-13, there is shown an alternate exemplary embodiment of the invention, in which similar reference characters denote similar elements throughout the several views. The attached figures illustrate a blowback bolt having and axially relieved stripping lip or "strip-lip" in which the magazine facing portion of the bolt surface (FIG. 5, 120) is relieved back from the main bolt to barrel impact surface (FIG. 5, 110), and laid back via bevel, chamfer or radius (FIG. 5, 130) to more smoothly strip the cartridge from the magazine. The strip-lip thus creates an axially relieved impact surface of the bolt (FIG. 5, 120) nearest the magazine. While removing the cartridge from the magazine, the lateral guiding of the cartridge via the side controlling walls or lateral guides (FIG. 5, 140) created by the differential surface transition between the bolt impact surface (FIG. 5, 110) and the magazine side relieved surface (FIG. 5, 120) maintain additional lateral cartridge control not previously attainable while loading the cartridge to the eventual firing position centrally located (FIG. 5, 150) with the bolt seated against the barrel.

Figure 6:
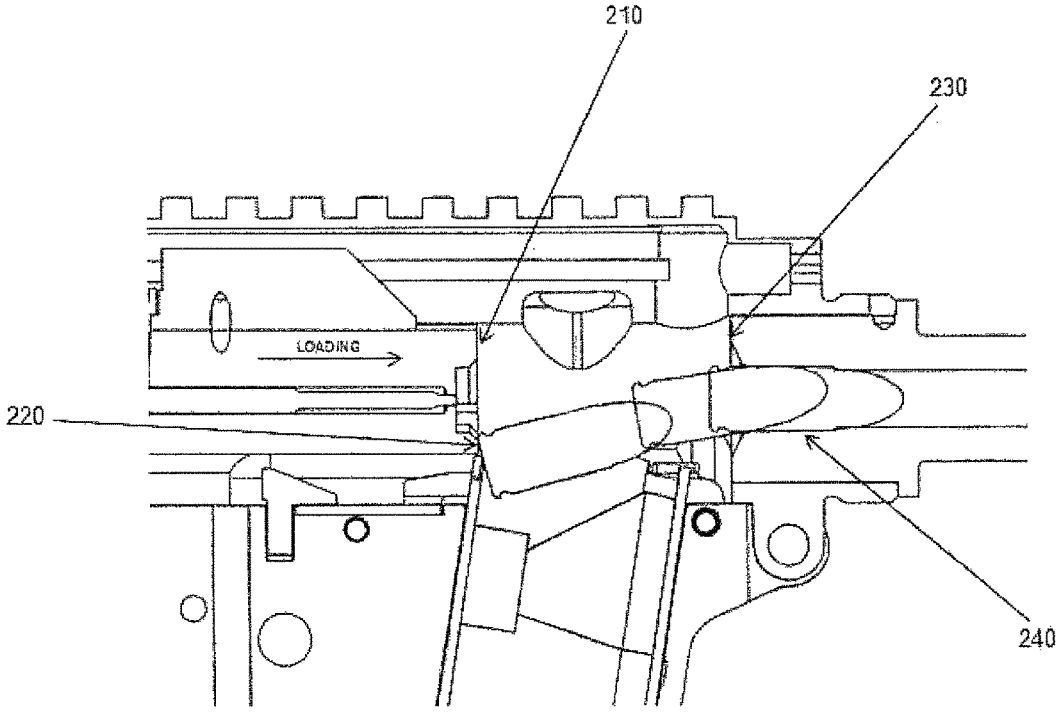
FIG. 6 PRIOR ART
FIG. 6 is a Prior Art diagrammatic cross-sectional view of a machine pistol at the cartridge loading start stage.
Figure 7:
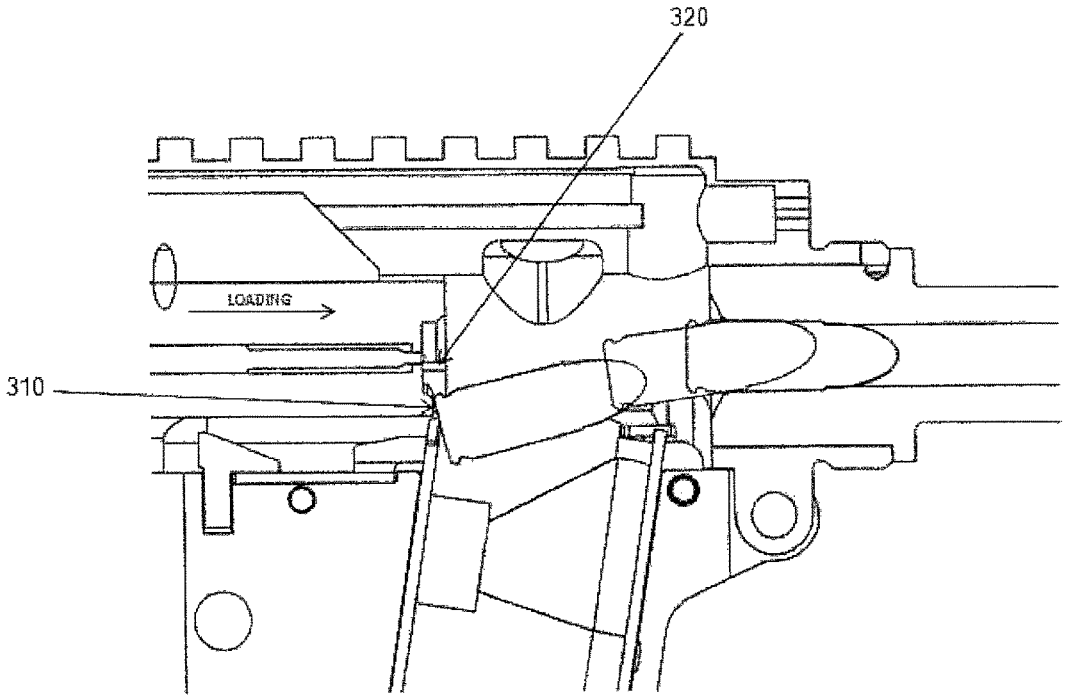
FIG. 7 is a diagrammatic cross-sectional view of a machine pistol using the bolt of FIG. 5 at the cartridge loading start stage.

As shown in FIG. 6, prior art firearm bolts have traditionally maintained a singular plane for an impact surface (FIG. 6, 210) against the cartridge (FIG. 6, 220) and butting surface of the barrel (FIG. 6, 230) while chambering (FIG. 6, 240) the cartridge, or round.

In contrast the strip-lip bolt of the invention has part of this leading bolt/barrel impact surface (FIG. 5, 120), (FIG. 7, 310) relieved back from the impact plane such that the geometry of loading the cartridge to chamber is separately optimized, and control of the cartridge is more consistently maintained without creating tighter machining tolerances. The strip-lip at the impact face of the bolt breaks from the prior art convention of a singular control plane at the leading edge of travel of the bolt for the cartridge and barrel interface. By altering the interface in the direction of the cartridge magazine to optimize chambering timing and geometry, one creates an independent timing profile of cartridge stripping and loading versus bolt travel velocity which more smoothly loads the cartridge.

Figure 8:
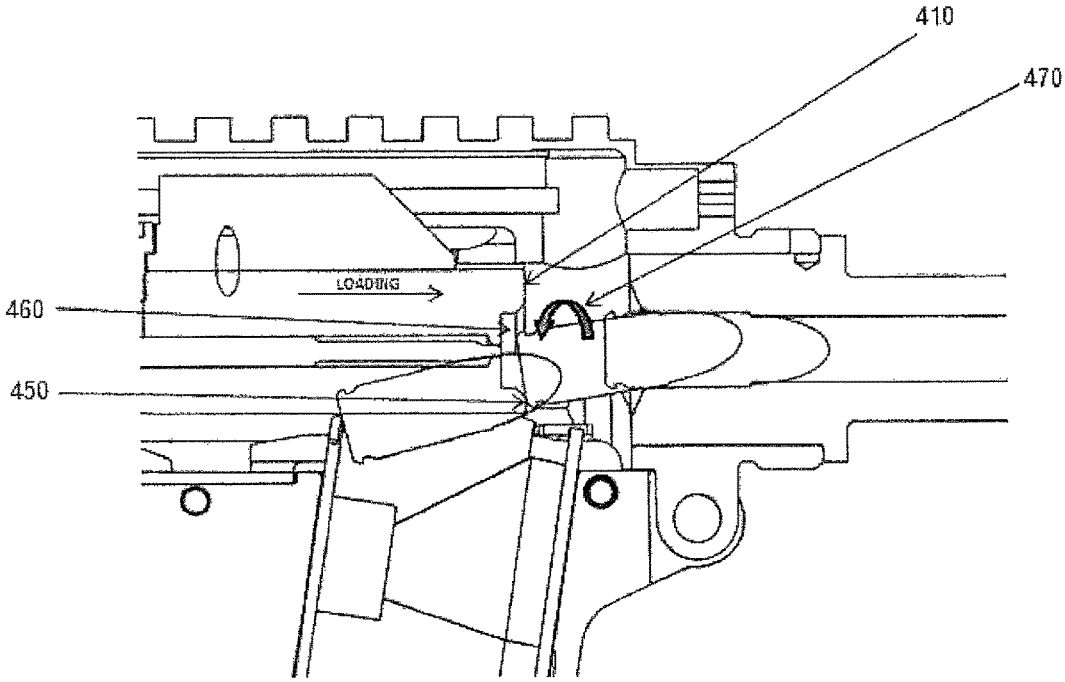
FIG. 8 PRIOR ART
FIG. 8 is a Prior Art diagrammatic cross-sectional view of a machine pistol at the cartridge loading mid-point stage.
Figure 9:
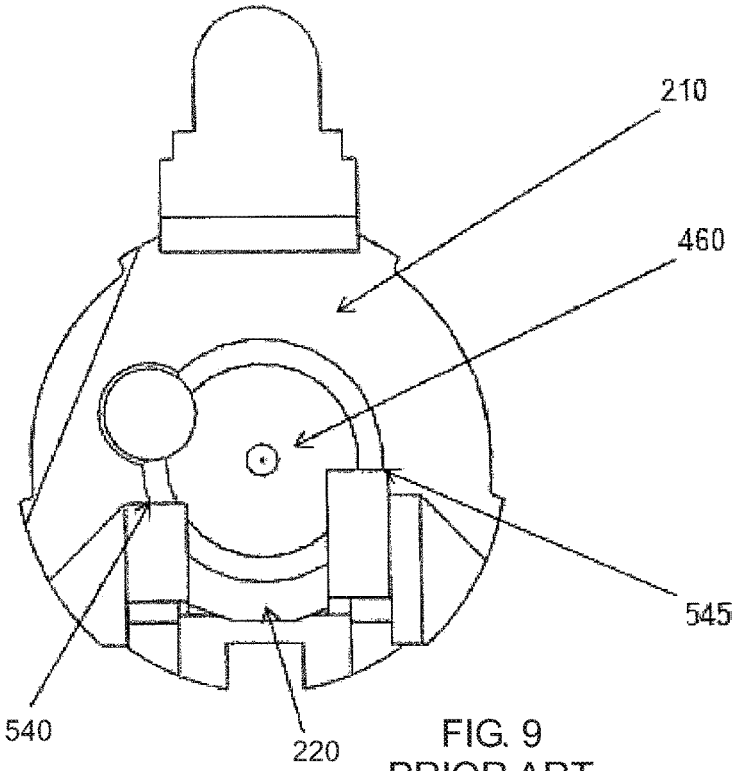
FIG. 9 PRIOR ART
FIG. 9 is a Prior Art diagrammatic elevational view of a machine pistol bolt distal face which interfaces the cartridge.
Figure 10:
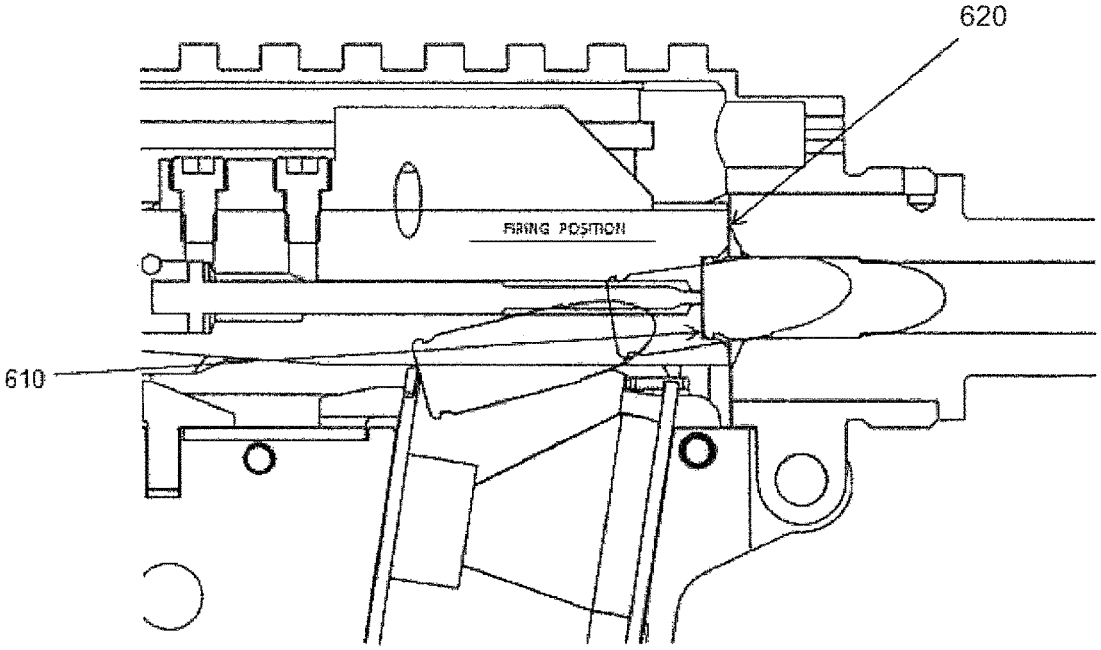
FIG. 10 PRIOR ART
FIG. 10 is a Prior Art diagrammatic cross-sectional view of a machine pistol at the cartridge loaded stage.

As shown in FIGS. 8-10, prior art bolts accelerate the cartridge at bolt speed to the chamber until the cartridge is partially loaded, whereupon the cartridge falls free from the leading edge of the bolt (FIG. 8, 450) into the cartridge counterbore (FIG. 8, 460) within the bolt, sometimes catching on interfering geometry (FIG. 9, 540, 545), then reaccelerating the cartridge (FIG. 10, 610) to the loaded position (FIG. 10, 620).

Figure 11:
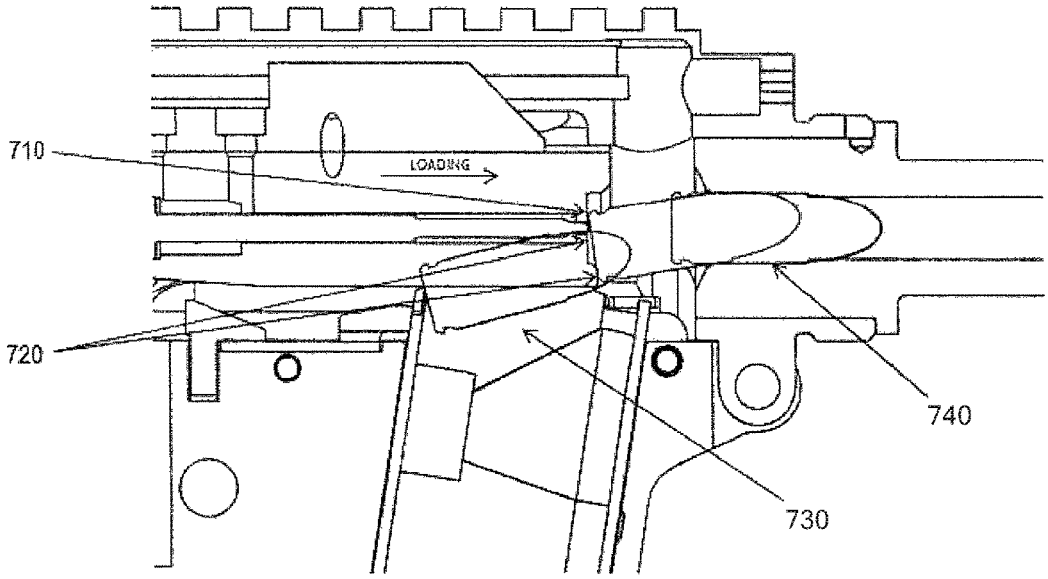
FIG. 11 is a diagrammatic cross-sectional view of a machine pistol using the bolt of FIG. 5 at the cartridge loading mid-point stage.
Figure 12:
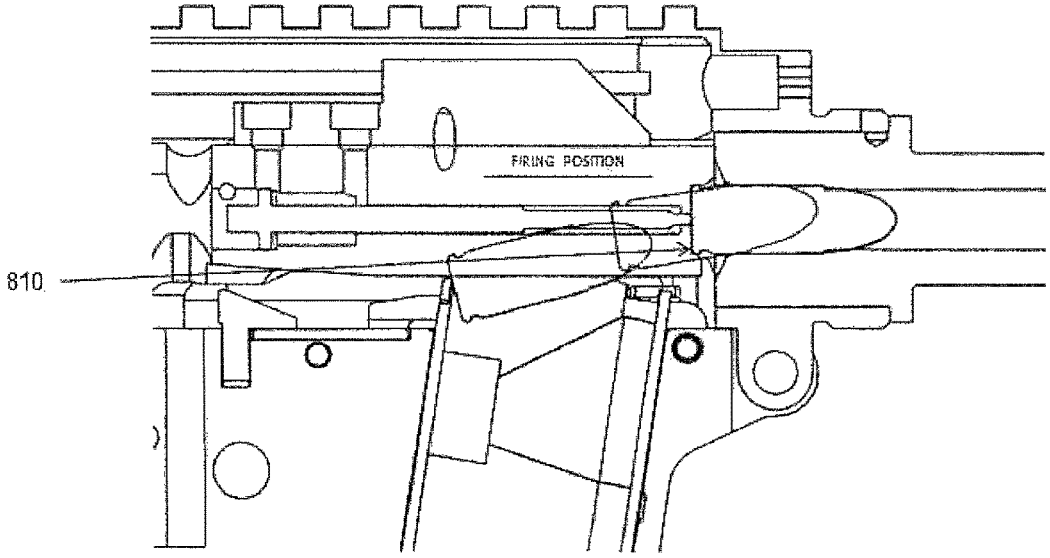
FIG. 12 is a diagrammatic cross-sectional view of a machine pistol using the bolt of FIG. 5 at the cartridge loaded stage.
Figure 13:
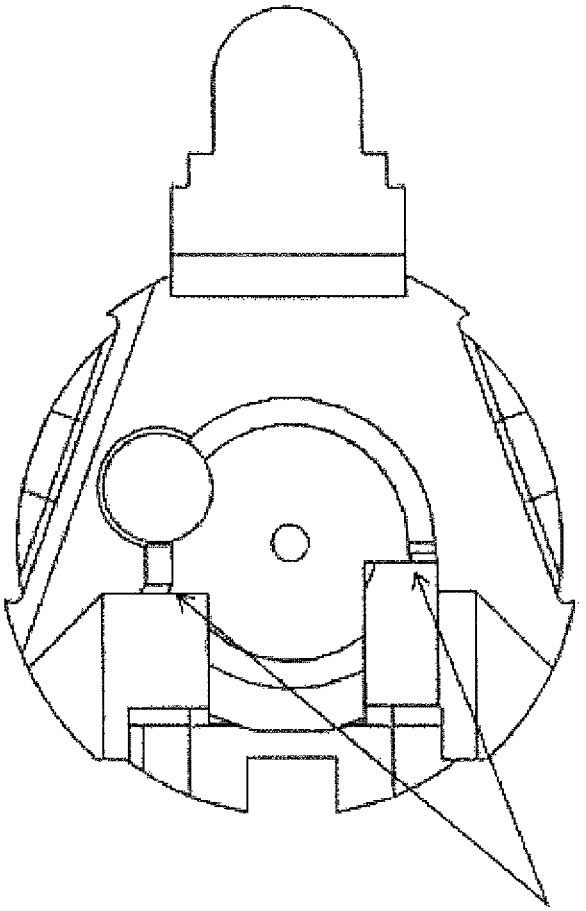
FIG. 13 is a diagrammatic elevational view of a machine pistol bolt of FIG. 5 showing the distal face which interfaces the cartridge.

In contrast, the axially relieved strip-lip of the invention is relieved as needed at the magazine feed position to strip the cartridge at the beginning of load process (FIG. 7, 310) and scoop it (FIG. 11, 710) into the firing position while loading into the chamber (FIG. 12, 810) without velocity deviation (FIG. 11, 720).

In this way, the interfering geometry (FIG. 13, 910) and loss of lateral control (FIG. 8, 470) suffered by the prior art has been removed.

Figure 5:
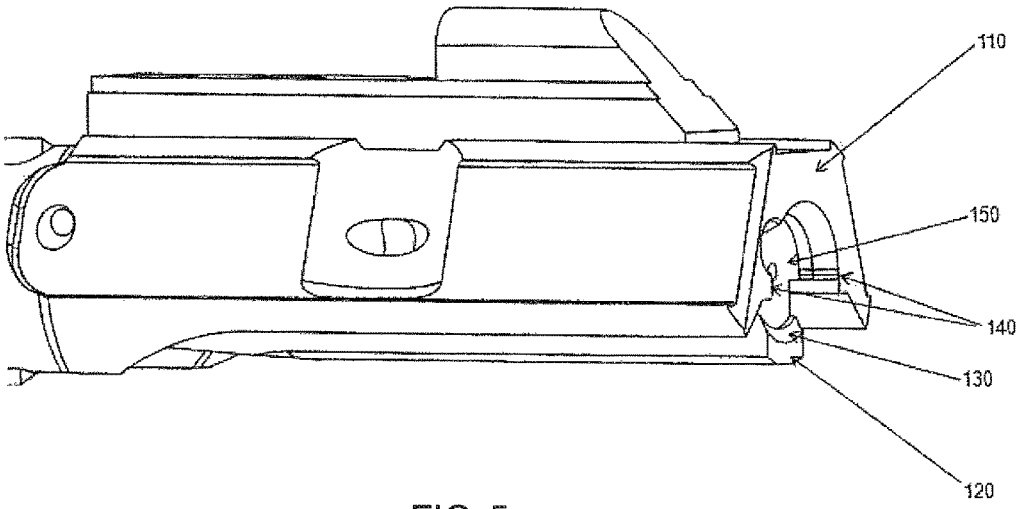
FIG. 5 is a diagrammatic isometric view of a bolt having an axially relieved lower lip structure according to an alternate exemplary embodiment of the invention.

As shown in FIGS. 5 and 11, the axially relieved strip-lip of the invention provides channel type guiding for the cartridge. Lateral guiding of the cartridge during loading is accomplished by the "channeling" effect made when machining the relieved strip-lip, or relieved surface (FIG. 5, 120) from the bolt at the bolt-to-barrel interface plane (FIG. 5, 110). Machining a relieved surface into the end of a cylindrical surface, and chamfering (FIG. 5, 130) or interpolating a chamfer or radius from that lowered surface yet further into a relieved counterbore (FIG. 5, 150) creates side walls (FIG. 5, 140) much like that of canyon walls. It is these chamfered side walls (FIG. 5, 140) along the path of the chamfered or interpolated lead to the cartridge seating counterbore FIG. 5, 150) that guide laterally the cartridge during loading from the magazine (FIG. 11, 730) to the barrel chamber (FIG. 11, 740). The lateral guiding can be created though general machining, electrical discharge machining (EDM) or a host of other manufacturing processes obvious to those skilled in the art.

The main components of this invention are the strip-lip (FIG. 5, 120), and the lateral guides (FIG. 5, 140) and their cooperative function. The strip-lip is a magazine facing section of the bolt that is relieved axially (FIG. 5, 120) so as that it will not only extract the cartridge from the magazine (FIG. 11, 730), but also scoop the rimmed rear end of the cartridge into the seated position. This scooping, or camming process of the cartridge to the centered seated and firing position maintains a more consistent velocity matching that of the bolt travel, without the change in velocity experienced by the prior-art bolts when the cartridge decelerates when it drops (FIG. 8, 450) into the piloted firing position bore (FIG. 8, 460). At the sides of the strip-lip scooping profile for the cartridge are lateral guides (FIG. 5, 140). These lateral guides act to "funnel" the cartridge rim to the centered and seated firing position while the cartridge is loaded into the barrel chamber. The lateral guides (FIG. 13, 910) have been created where prior-art bolts typically have geometric features (FIG. 9, 540, 545) that can catch on the loading cartridge. Unlike prior-art bolts, these lateral guides are engaged from early contact (FIG. 7, 320) between bolt and cartridge. The strip-lip bolt concept is a departure from prior-art convention of the contact plane of impact between the bolt and barrel; to break from square face, brute-force cartridge loading. The strip-lip variations would be any derivative where instead of simply driving a round into the chamber, the bolt is fitted with a scooping, or cam profile on the contact surface of the bolt to not only drive the cartridge to the chamber, but to utilize vectored impact and driving force and lateral guiding to control the rear of the cartridge during a more consistent loading velocity.

In this way, the axially relieved strip-lip equipped bolt, upon first contact with the cartridge during loading to the chamber the rim of the cartridge is constrained laterally with a side guiding channel. During the load cycle the cartridge is contacted by a relieved leading edge which starts the removal of the cartridge from the magazine with frictional resistance only. By the time in the cycle where the cartridge is freed from the constraints of the magazine where the magazine's lateral forces could divert the rim end of the cartridge, the cartridge has been scooped into the recessed bore firing position within the bolt with lateral guides. The load cycle continues to firing position in the barrel chamber without the velocity change of falling over the prior-art lip.

In this way, while stripping the cartridge from the magazine, the side guiding of the cartridge via the side controlling walls created by the differential surface transition between the bolt impact surface and the magazine side relieved surface maintain additional lateral cartridge control not previously attainable. The invention consists of the axially relieved impact surface of the bolt nearest the magazine, and the channel type guiding for the cartridge created when creating the relieved impact surface of the strip-lip, or relieved lip nearest the magazine.

In this way, the axially relieved strip-lip blow-back bolt better controls and feeds cartridges into the chamber of firearms.

As to a further discussion of the manner of usage and operation of the present invention, the same should be apparent from the above description. Accordingly, no further discussion relating to the manner of usage and operation will be provided. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Although the above embodiment or embodiments of the invention have been described in detail, it is to be understood that the invention is not limited in its application to the details of construction and to the arrangements of the components set forth in the description or illustrated in the drawings. The invention is capable of other embodiments and of being practiced and carried out in various ways. Also, it is to be understood that the phraseology and terminology employed herein are for the purpose of the description and should not be regarded as limiting.

While the exemplary embodiments of the invention have been described, modifications can be made and other embodiments may be devised without departing from the spirit of the invention and the scope of the appended claims.

What is claimed is:

1. In a firearm having a bolt reciprocatingly sliding axially along a bolt axis, said bolt temporarily engaging an ammunition cartridge at a distal bolt end during a firing cycle, wherein said ammunition cartridge includes a cylindrical case portion having a proximal circular rim, an improvement which comprises:

a distal bolt face which comprises:

a distal impact surface;

a substantially circular counterbore seat radially adjacent to said distal impact surface;

a distally projecting arcuate guidewall partially surrounding an upper portion of said seat;

said guidewall being angularly limited to provide a lower angular gap; and an axially relieved lip located within said gap;

wherein said lip comprises a distally projecting pedestal radially adjacent to said seat; and wherein said substantially circular counterbore seat and said pedestal simultaneously contact said proximal circular rim during a mid-point of the stripping and chambering stages of said firing cycle.

2. The improvement of claim 1, which further comprises:

a pair of lateral guides formed onto the angular extremities of said guidewall.

3. The improvement of claim 2, wherein each of said lateral guides forms a gradual transition between a radially inner surface of said guidewall and an angular edge of said guidewall.

4. The improvement of claim 1, wherein said lip is shaped and dimensioned to allow simultaneous contact between said lip, said rim and said counterbore seat.

5. The improvement of claim 1, wherein said bolt strips and chambers a cartridge at substantially the same velocity as a return stroke of the bolt.

6. The improvement of claim 1, which further comprises:

said distal impact surface being substantially planar, located within a first plane;

a distal surface of said lip being substantially planar, located within a second plane; and, wherein said first plane is located an axial distance distal to said second plane.

7. The improvement of claim 6, wherein said first and second planes are substantially parallel.

8. The improvement of claim 6, wherein said second plane is substantially perpendicular to a sliding axis of said bolt.

9. The improvement of claim 1, wherein said angular gap is between about 150 degrees and about 160 degrees.

10. The improvement of claim 1, wherein said pedestal is symmetric about a vertical plane bisecting said seat.

11. The improvement of claim 1, wherein said lip further comprises a concave arcuate radially inwardly facing lip wall shaped and dimensioned to nest against a convex surface of said rim.

12. The improvement of claim 11, wherein said lip wall and said rim have commensurate radii of curvature.

13. The improvement of claim 12, wherein said lip further comprises a pair of convex corners straddling said lip wall.

14. The improvement of claim 1, wherein said pedestal has axial dimension of between about 0.053 and about 0.057 inch.

15. The improvement of claim 1, wherein said lip further comprises a ramp extending radially inwardly and proximally forming a gradual transition surface to said pedestal.

16. The improvement of claim 1, which further comprises an extractor mechanism having a radially moveable hook oriented to contact said cartridge.

17. A method for stripping an ammunition cartridge from a magazine and chambering said cartridge in the chamber of a firearm using a blowback bolt having a proximal counterbore seat, said cartridge case having a proximal rim, said method comprises:

simultaneously contacting said rim by a first surface on a pedestal extending distally from a lower lip of said bolt adjacent to said seat, and a second surface on said counterbore seat.

* * * * *